US006748602B1

(12) United States Patent
Barnes

(10) Patent No.: US 6,748,602 B1
(45) Date of Patent: Jun. 15, 2004

(54) DECORATIVE MAGNETIC COLLAR STAY

(76) Inventor: Arthur William Barnes, 837 Shady Brook Dr., Marietta, GA (US) 30066

( * ) Notice: Subject to any disclaimer, the term of this patent is extended or adjusted under 35 U.S.C. 154(b) by 0 days.

(21) Appl. No.: 10/689,768

(22) Filed: Oct. 21, 2003

(51) Int. Cl.[7] ..... A41B 3/00
(52) U.S. Cl. ..... 2/132
(58) Field of Search ..... 2/131, 132, 133–139, 2/255–260, 260.1, 261, 262, 231, 232, 115, 116, 129, 60, 141.1, 144, 145, 156, 130, 155; 24/303, 66.1, 658, 688

(56) References Cited

U.S. PATENT DOCUMENTS

| | | | | | |
|---|---|---|---|---|---|
| 459,942 | A | * | 9/1891 | Brown | 600/15 |
| 2,397,931 | A | * | 4/1946 | Ellis | 24/303 |
| 2,964,756 | A | * | 12/1960 | Liebowitz | 2/132 |
| 3,086,268 | A | * | 4/1963 | Chaffin, Jr. | 24/303 |
| 3,102,314 | A | * | 9/1963 | Alderfer | 24/303 |
| 3,161,932 | A | * | 12/1964 | Anne | 24/303 |
| 3,509,734 | A | * | 5/1970 | Lederer | 63/15 |
| 3,686,692 | A | * | 8/1972 | Snare et al. | 2/132 |
| 3,909,850 | A | * | 10/1975 | Scott | 2/132 |
| 4,118,803 | A | * | 10/1978 | Blau | 2/132 |
| 4,286,337 | A | * | 9/1981 | Malouf, Jr. | 2/116 |
| 4,434,512 | A | * | 3/1984 | Hansen | 2/129 |
| 4,653,119 | A | * | 3/1987 | Kaiser | 2/60 |
| 4,922,553 | A | * | 5/1990 | Morrone | 2/132 |
| 4,959,890 | A | * | 10/1990 | Pazurek | 24/113 MP |
| 5,626,267 | A | * | 5/1997 | Peruski | 223/84 |
| 5,732,451 | A | * | 3/1998 | Mars | 24/303 |
| 5,740,557 | A | * | 4/1998 | Reid et al. | 2/209.13 |
| 5,974,634 | A | * | 11/1999 | Eisenpresser | 24/303 |
| 6,167,732 | B1 | * | 1/2001 | Friedman | 66/173 |
| 6,170,131 | B1 | * | 1/2001 | Shin | 24/303 |
| 6,226,842 | B1 | * | 5/2001 | Wong | 24/303 |
| 6,434,801 | B2 | * | 8/2002 | Grunberger | 24/303 |

* cited by examiner

*Primary Examiner*—Tejash Patel

(57) ABSTRACT

This invention relates to a novel design of decorative, detachable/attachable magnetic collar stay devices to be used on the collars of sports shirts. The magnetic portions of the device are arranged so that the top portion and bottom portion of the device have opposite polarities from each other. The bottom portion is enabled to receive collar stays of various lengths. The outward surface of the top portion has a relatively flat surface enabled for the affixing of a decorative element.

5 Claims, 2 Drawing Sheets

DECORATIVE MAGNETIC COLLAR STAY

BACKGROUND OF THE INVENTION

1. Field of the Invention

The present invention relates generally to an improved device for collar-attached shirts made of machine knitted fabric, the improved device, more particularly, enhancing the appearance of the collars by providing a neat and tidy shirt collar, while providing distinctive decorative qualities, while minimizing intrusion or abrasion of the collar.

2. Discussion of Related Art

There are other anti-curling devices for shirt collars. Typical of these are the following.

U.S. Pat. No. 2,964,756

Inventor: Benjamin Liebowitz

Issued: Dec. 20, 1960

Title: Anticurl Devices

This United States patent discloses means for preventing undesired curvature of garment parts such as men's and boy's shirt collars.

U.S. Pat. No. 3,686,692

Inventor: Victor Snare, et al.

Issued: Aug. 29, 1972

Title: Means For Stiffening Collars

This United States patent discloses a stiffener for a front pointed edge of a soft collar made of thin flexible plastics material having a V-shape rib pressed out from one face and a single straight rib pressed out from the other face and which extends centrally of said V-shape rib and passes through the apex thereof.

U.S. Pat. No. 4,118,803

Inventor: Harry Blau

Issued: Oct. 10, 1978

Title: Collar Stay System

This United States patent discloses an improved collar stay system, including a collar stay which engages with the tip of the collar at one end and a hinge member provided on a collar of a shirt. The hinge member is arranged and configured to engage with and hold the other end of the collar stay whereby a collar of new appearance is presented.

U.S. Pat. No. 4,286,337

Inventor: Edmond Malouf, Jr.

Issued: Sep. 1, 1981

Title: Shape Retaining Collar Devices

This United States patent discloses a shape retaining collar device for use with garments of wearing apparel as for example, a shirt having a torso covering segment. The shape retaining collar device in the garment construction includes a first fabric portion which is attachable to the torso covering segment and which is generally non-exposed to a viewer.

U.S. Pat. No. 4,434,512

Inventor Vagn Hansen

Issued: Mar. 6, 1984

Title: Stayless Shirt Collar

This United States patent discloses a shirt collar which eliminates the need for stays, but yet lies flat and maintains a crisp and neat appearance with time. The disclosed collar includes a flexible lining material characterized in that it is relatively stiff in the transverse direction of the collar and relatively flexible in the longitudinal direction.

U.S. Pat. No. 4,653,119

Inventor: Walter Kaiser

Issued: Mar. 31, 1987

Title: Clothing Protector

This United States patent discloses a disposable protector for a garment collar made up of a thin plastic sheet of water impervious material glued to a first side of a non-woven material and a pressure sensitive adhesive surface on the second side of the sheet. A removable paper strip is attached to the pressure sensitive material which can be removed and the protector attached to a garment collar band by means of the pressure sensitive adhesive with the non-woven material adjacent the neck of the wearer.

U.S. Pat. No. 6,167,732

Inventor: Marc Friedman

Issued: Jan. 2, 2001

Title: Knitwear Having No Curl Collars

This United States patent discloses for a selected collar stay, i.e., 0.375 inches in width, for a shirt knitted with selectively sized wales, i.e., 0.10 inches in width, a pocket for the stay also knitted but with selectively narrower wales, i.e., 0.025 inches in width, so that predictably a number of wales, i.e., 14 in number, produces a width of the pocket approximately equal to the width of the stay to minimize movement of the stay within the pocket.

There are other magnetic clothing related devices. Typical of these are the following.

U.S. Pat. No. 2,397,931

Inventor Robert Ellis

Issued: Apr. 9, 1946

Title: Magnetic Button

This United States patent discloses a magnetic button which has the general appearance of an ordinary button but is made in two associated parts which are each oppositely attached to a closure flop of a garment and hold the flaps together by inherent magnetic attraction.

U.S. Pat. No. 3,086,268

Inventor Leo Chaffin, Jr.

Issued: Apr. 23, 1963

Title: Separable Two-Part Magnetic Connector

This United States patent discloses an improved separable two-part magnetic connector.

U.S. Pat. No. 3,161,932

Inventor: Anne Russell

Issued: Apr. 15, 1963

Title: Magnetic Fastener

This United States patent discloses closures and closure fasteners for garments, particularly for baby garments and other fragile fabrics.

U.S. Pat. No. 5,732,451

Inventor: Mary Mars

Issued: Mar. 31, 1998

Title: Magnetic Attachment Device

This United States patent discloses a device for magnetically attaching jewelry, name tags or the like to garments. The device includes inner and outer magnets and an anchor attached to the outer magnet. A pin-secured jewelry article or name tag is secured to the garment by passing the pin through a passageway in the anchor and then bringing the inner and outer magnets into magnetically close proximity on opposite sides of the garment.

U.S. Pat. No. 6,170,131

Inventor Kyu Shin

Issued: Jan. 9, 2001

Title: Magnetic Buttons and Structures Thereof

This United States patent discloses detachable/attachable magnetic buttons that can be used on clothes, accessories, and the like. Specifically, the invention also relates to a contact guiding structure of the button for a smooth detaching/attaching and an improved stability thereof. The magnetic button of the present invention is arranged so that the magnets on the flap and the body have opposite polarities from each other. Each magnet housing is placed around each magnet in order to make one magnet to be placed in that of the corresponding opposite button. Furthermore, to prevent magnets from slipping and to enhance their durability, a barrier is placed between the magnet and the housing. Hence, the stability of the contact portion of the button and the smooth detachment/attachment are more facilitated.

U.S. Pat. No. 6,226,842

Inventor: Sheung Wong

Issued: May 8, 2001

Title: Waterproof, Washable Plastic Magnetic Button

This United States patent discloses a plastic magnetic button that is waterproof and washable includes a button body, a magnet and a steel plate disposed inside the cavity of said button body. The magnetic button can be used on clothes, can automatically align and match each other and is best suited for the case where buttons are not easy to be unbuttoned with the hands, such as, when both hands are in gloves.

U.S. Pat. No. 6,434,801

Inventor Erico Grunberger

Issued: Aug. 20, 2002

Title: Magnetic Closure For Items Of Clothing

This United States patent discloses a magnetic closure particularly for items of clothing and the like, comprising a magnetic body which is accommodated in a seat which is closed hermetically and is formed by two plate-like elements which are mutually coupled at least in a region which peripherally surrounds the magnetic body. The coupled plate-like elements can be applied to each one of a couple of flaps to be joined.

There are other magnetic adornment devices. Typical of these are the following.

U.S. Pat. No. 3,509,734

Inventor: Henry Lederer

Issued: May 5, 1970

Title: Ornamental Device With Interchangeable Magnetically Biased Member

This United States patent discloses an ornamental device comprising a base element and ornament element detachably mounted thereto said elements being mutually magnetically attractive, said ornament element having a raised portion adapted to snugly fit a corresponding cavity portion provided in the base element; the ornament element being further provided with at least one pin-like projection adapted to be engaged by a corresponding hole present in the base element whereby to promote structural stability.

U.S. Pat. No. 5,974,634

Inventor Kenneth Eisenpresser

Issued: Nov. 2, 1999

Title: Decorative Multi-Use Magnetic Buttons

This United States patent discloses a decorative multi-use magnetic button construction which includes a decorative shell having a cavity therein which contains a first magnet which contacts the base of the present invention which base contacts the outer surface of, for example, a human ear or garment and is held in place on the ear by attraction to a second magnet on the opposite side of the ear. This provides a structure which is securely attached to the ear or garment and allows interchangeable decorative shells to be alternatively and permanently connected to the base.

Finally, previous attempts to combine clothing attachments with decorative attributes include the following.

U.S. Pat. No. 4,922,553

Inventor James Morrone

Issued: May 8, 1990

Title: Decorative Shirt Collar Support Device

This United States patent discloses a decorative shirt collar support device preferably in combination with a decorative clip. The support device includes a support band adapted to be positioned under the collar. The decorative clip has a base and, integral therewith, opposing legs having upper free ends that are adapted to be disposed closely adjacent to each other forming a deflectable gap in which the shirt collar may be inserted A sliding member is adapted for use with the clip and also has a leg adapted to be received by the clip and an inner leg that may preferably have a sticky back substance for attachment to the shirt.

U.S. Pat. No. 4,959,890

Inventor Mary Pazurek

Issued: Oct. 2, 1990

Title: Interchangeable Snap Button System

This United States patent discloses an interchangeable snap button system permits the user to change the appearance of a blouse, dress or jacket by changing the appearance of the buttons. A combined female snap member and button is formed of a conventional-type female snap member with a metal loop secured on the back thereof so it may be sewn onto a garment, serving as a button Sets of different decorative members have male snap members bonded to them, and may be selectively snapped onto the female snap and button member.

U.S. Pat. No. 5,740,557

Inventor: Gregory Reid

Issued: Apr. 21, 1998

Title: Magnetic Image-Display System For Apparel

This United States patent discloses a system that modifies apparel, including baseball-style hats, by incorporating a portion of magnetic material into the article of apparel which allows for releasable attachment of a plurality of magnetic-based display panels.

One past attempt to address the problem of keeping the collars of knit sports shirts from curling has involved using an adhesive device under the collar. One adhesive device is a commercially available product called CollarSTYX™, U.S. Pat. No. 6,089,422 to Lee Gibson on Jul. 18, 2000, Collar Stiffening Device and Method, that is supposed to keep your collar straight. It is a piece of plastic that has adhesive on one side that is designed to adhere to the back of your shirt. The instructions state that you can take it on and off about ten times before the adhesive wears off. When looking at the shirt you cannot tell that the product is in use. It is also disposable. It is designed to keep collars straight. It is a totally different solution that comes in one size so no matter how big your collar is. It is designed to keep the bottom of the collar flat. The adhesive device solution has several problems: leaving a residue when removed, not being removed from the collar prior to washing, and coming off during washing when left on the collar.

Another past attempt to address the problem of keeping the collars of knit sports shirts from curling has involved sewing a collar stay receptacle under the collar during manufacture. The problem with this solution it that it has not been widely embraced by the manufacturers of polo-type sports shirts, plus it does not offer any decorative elements.

SUMMARY OF THE INVENTION

The present invention addresses these and other needs in the industry by providing a device that will keep any collar straight and looking neat, while providing decorative elements.

The present invention is comprised of two major pieces. The bottom piece is comprised of a tub containing two magnets, with a cavity appropriately sized for snug insertion of any length collar stay; said tub has a nose or ridge that is strategically placed to work complimentary with the top piece, to form and secure any collar. A collar stay of the appropriate length is inserted into the cavity in the bottom piece. The length of the collar stay piece used depends on the size of the collar that is the target of the present invention.

The top piece is comprised of a cover that looks similar to a nose plug. Said cover contains two magnets, arranged to be attracted to the magnets of the bottom piece, and when set on top of a collar with bottom piece positioned correctly directly underneath said collar, locks the bottom and top pieces into place via magnetic attraction. The top piece has a relatively flat area on the top side of the cover that provides a bridge on the cover for placement of the customized logo, name, decoration, etc. A pin top piece containing said logo, etc. is affixed to the bridge area. Any suitable lapel-like logo device can serve as the pin top for affixing to said bridge.

The present invention solves four problems. First and foremost, non-button-down sports shirts, and in particular, any and all golf and polo style shirts, no matter how much they cost, after wearing them once, the collars tend to curl to some kind of degree. The present invention takes the curl out of collars and makes them look neat every time you wear them, no matter how your collars look when they come out of the wash.

Second, when a collar curls anywhere, it throws the whole collar out of alignment, often the back of a collar will curl in strange ways all due to the curling that always starts at the ends. With the present invention anchoring your collars, the entire collar stays.

Third, advertising specialty companies and golf tournament directors are all looking for new and different logo-able items that are easy to sell to corporations. One criteria generally used is that the companies want to see something that is novel and practical—something that everyone will want to wear that also solves a problem, while displaying a company's logo in a distinctive manner. Often these items are packaged as part of a sponsorship package to entice corporations to sponsor events and have access and be able to influence certain groups of people. Along this same line, golf course and pro shop owners and country clubs are always looking for items they can put their club's logo on that will be bought giving them a profit and used by golfers, giving them exposure to other golfers around the world. Most items sold in any pro shop have the logo of that golf club on it.

Fourth, having a unique decorative top to the present invention is appealing to the collectibles and handcrafts markets. This includes creating limited editions, framing and other displays as well as trading of the present invention, either in total or just the top piece, as well as creating personalized versions.

Potential purchasers of the present invention include advertising specialty companies, sponsors of golf tournaments, makers and vendors of golf products, the clothing companies, those associated with collectibles, fast food restaurants that wear sports shirts as a uniform, as well as related industries. Examples include The PGA Tour, The Golf Channel, Titelist, Callaway Nike, Precept, Taylor Made, Cleveland Golf, Adams Golf, Srixon, MacGregor, Ben Hogan, Adidas, Etonic, FootJoy, Acushnet, USGA, Greg Norman Apparel, Chic-Fil-A, McDonalds.

The present invention can be detached an infinite number of times without pulling fibers off your shirt. It is a collar stay designed to work as if you were wearing a dress shirt You can put any size collar stay in the present invention to make any size collar look great, plus you can put any logo on top of the present invention to customize it. The present invention is different because you can put anything that would go on a tie tack or lapel pin on top of the present invention. With the present invention a company's logo appears on both collars and unlike logos imprinted on collars that curl and mangle, these logos always look great because the collar below always stays straight, plus the logo is raised and looks almost three dimensional. The present invention keeps your collar straight while wearing it, plus it is detachable so you can use it on every collared shirt you have.

With the present invention, every shirt that you are reluctant to wear now due to collar curl can look new again.

The main reason people stop wearing their shirts is that their collars do not look good when they put their shirts on. Since the present invention is detachable you only need one to improve your whole wardrobe. A cavity is included within the bottom piece of the present invention so you can insert any size collar stay to adjust the present invention based on the size of your collar.

To use the present invention, insert the appropriate size collar stay into the bottom piece. Then take the point from the assembled bottom piece, place it underneath the collar and match it to the back point of the collar, closest to the neck. Center the back of the collar stay from the point of the collar stay and back point of the shirt in the desired postion, then attach the assembled top piece of the present invention to the top side of the shirt collar, such that the magnets of the top piece and bottom piece attract each other and lock the present invention in place with the cloth of the collar captured between.

PREFERRED EMBODIMENT

The preferred embodiment of the present invention uses nickel-coated Neodymium 35 disc magnets with a 0.250 inches outer diameter and 0.200 inches thickness, having a residual induction of 12,300 Gauss, a coercive force of 10,500 Oersteds, and an intrinsic coercive force of 12,000 Oersteds. The collar stays that are inserted into the bottom piece are custom made to fit snugly into the cavity and range in length from 1.5 inches to 3 inches. The material for the bottom and top piece is any suitable non-metallic material, for example, plastic. The preferred length of the tub is 1⅜ inches, where the top of the magnet is 3/16 inch from the outside of the top of the tub. Additionally, the preferred position of the magnet in the tub is such that there is ¾ inch from the tip of the nose of the tub to the nearest outside edge of the magnet The preferred distance between the widest part of the nose is 11/32 inch. The preferred drop from the top of the tub to the back of the magnet next to the butt of the tub is ⅛ inch. The preferred width of the neck of the tub at the narrowest point is ⅛ inch. In order to keep the collar fabric up on the shirts the preferred edge on the tub is ⅛ inch to the nearest outside edge of the magnet; this applies to both edges. The preferred cavity in the bottom piece is ⅜ inch in width and 1/16 inch in height.

The preferred dimensions of the top piece, or cover, are 11/16 inch in width and 13/16 inch in length. The preferred dimensions for the flat area on top of the cover are ¾ inch wide and ½ inch long for placement of the logo pin top to the cover. The preferred depth of the channel for the top piece is ⅜ inch, and the preferred width of the channel is slightly more than ⅜ inch, so that it molds itself to the bottom piece with the intervening cloth of the collar.

BRIEF DESCRIPTION OF THE DRAWINGS

Other advantages and features of the invention are described with reference to exemplary embodiments, which are intended to explain and not to limit the invention, and are illustrated in the drawings in which.

DETAILED DESCRIPTION OF THE INVENTION

Figure 1:
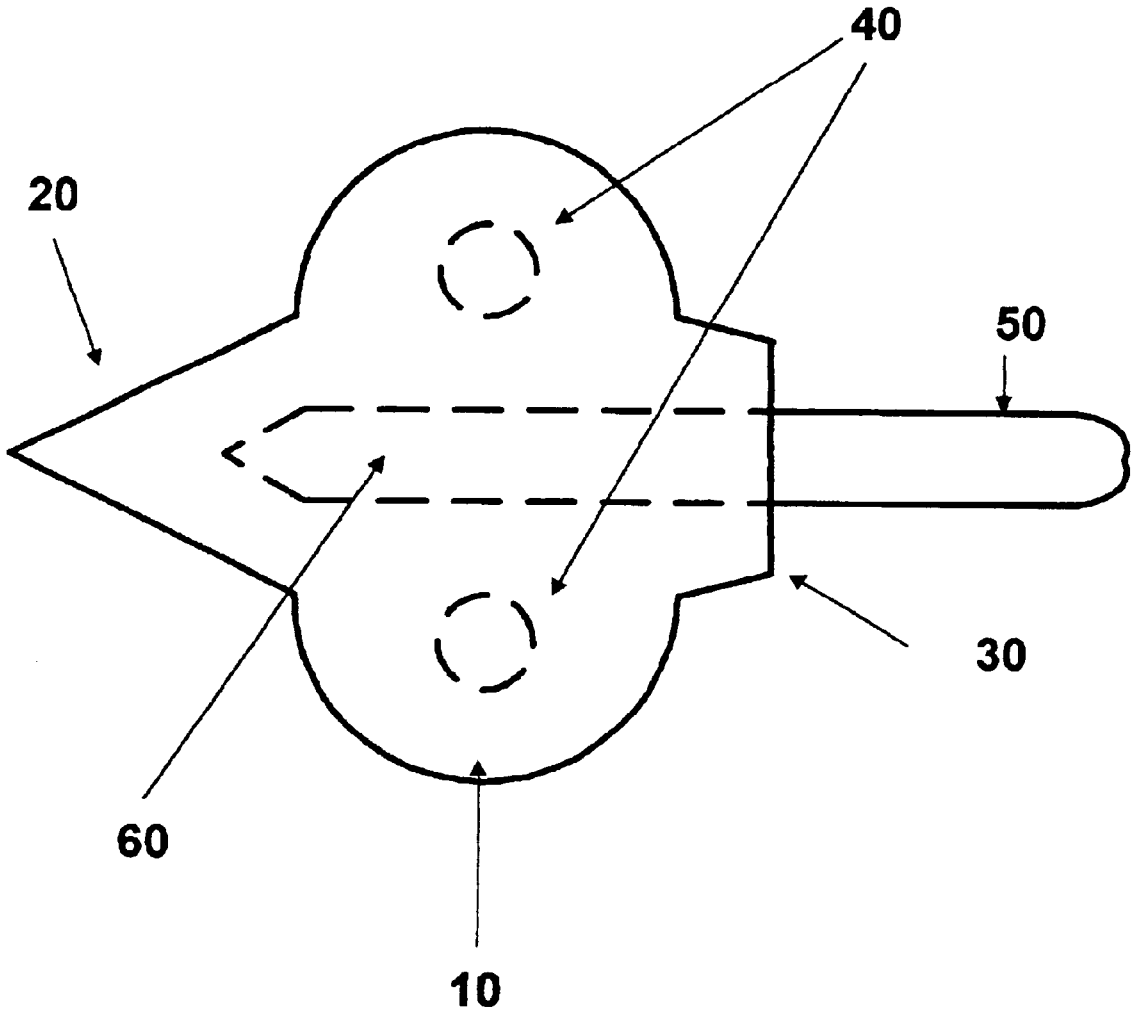
FIG. 1 is a top view of the bottom piece of the invention.
Figure 2:
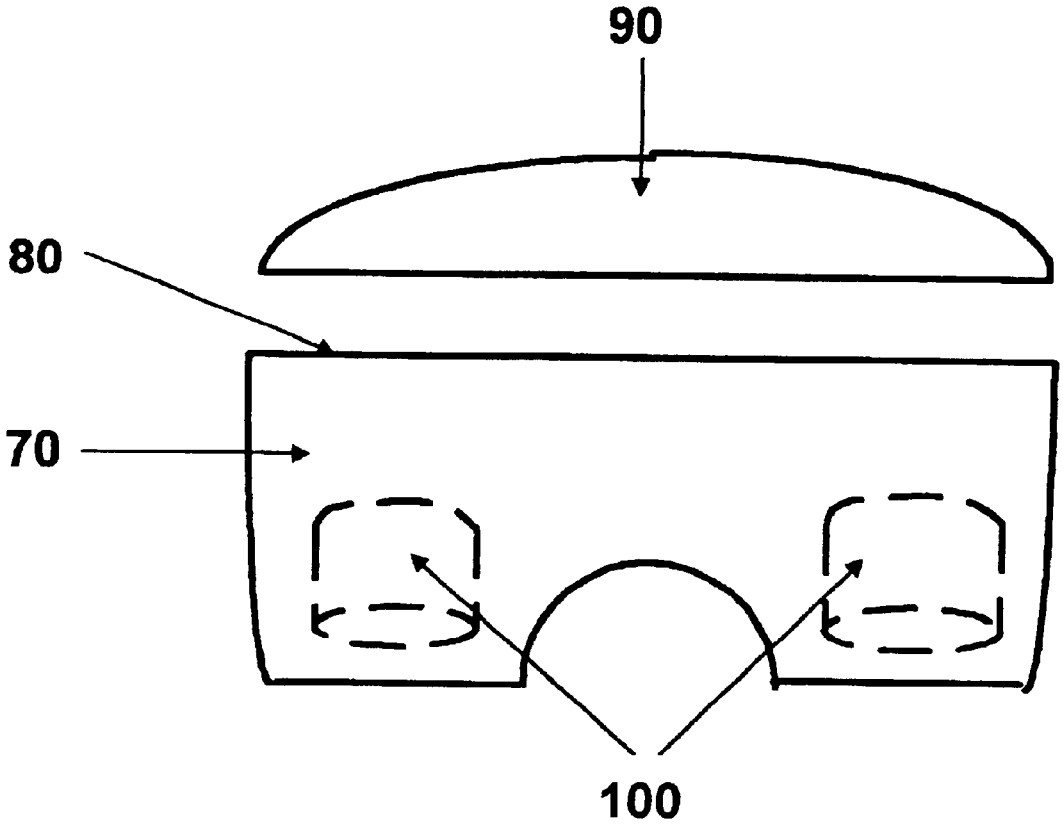
FIG. 2 is a back view of the top piece of the invention.

The bottom piece of the present invention is comprised of the tub 10, which has a nose 20 and a butt 30, magnets 40 which are affixed within the tub 10, a stay 50 which is inserted into the cavity 60.

The top piece of the present invention is comprised of a cover 70, said cover having a flat area 80 on the top side of the cover for the affixing of a pin top 90, said cover having magnets 100 that are positioned to be attracted to the magnets 40 in the bottom piece.

What is claimed is:

1. A magnetic collar stay device comprising:

a. a bottom body having a nose and butt b. a plurality of magnetic element disposed inside said bottom body, said magnetic elements each having one side with a N pole and the other, an S pole respectively, and being made of strong magnetic alloy, c. a cavity having a shape and size that matches with a removable collar stay, d. a removable collar stay inserted into said cavity e. a top body having a relatively flat area on the top side, f. a plurality of magnetic elements disposed inside the top body, said magnetic elements in the bottom body and top body being permanently magnetized and the abutting faces of which are of opposite magnetic polarity g. the abutting sides of said magnetic elements being interlockingly inclined, the degree of inclination of said sides being substantially the same on each respective magnetic element h. a decorative pin top affixed to the flat area on the top side of the top body.

2. The magnetic collar stay device according to claim 1, wherein said bottom body and top body are made of a non-magnetic material, preferably made of materials selected from ABS plastics, PVC resin, etc.

3. The magnetic stay device according to claim 2, wherein the magnetic elements are disc magnets.

4. The magnetic collar stay device according to claim 3, wherein said disc magnets are made of neodymium-iron-boron alloy of strong magnetism, minimum magnetic field density of 1,100 Gauss.

5. The magnetic collar stay device according to claim 4, wherein the number of magnets in the top body is two and the number of magnets in the bottom body is two.

* * * * *